US009016983B2

(12) United States Patent
Li et al.

(10) Patent No.: US 9,016,983 B2
(45) Date of Patent: Apr. 28, 2015

(54) METHOD FOR PREVENTING SHIELD CASING JAMMING DUE TO TOO LARGE FRICTIONAL RESISTANCE IN EARTH PRESSURE BALANCE SHIELD MACHINE

(75) Inventors: Jianbin Li, Zhengzhou (CN); Shunhui Tan, Zhengzhou (CN); Yulian He, Zhengzhou (CN)

(73) Assignee: China Railway Engineering Equipment Group Co., Ltd., Zhengzhou, Henan Province (CN)

( * ) Notice: Subject to any disclaimer, the term of this patent is extended or adjusted under 35 U.S.C. 154(b) by 0 days.

(21) Appl. No.: 14/123,063

(22) PCT Filed: Jun. 9, 2011

(86) PCT No.: PCT/CN2011/075493

§ 371 (c)(1),
(2), (4) Date: Nov. 27, 2013

(87) PCT Pub. No.: WO2012/162908

PCT Pub. Date: Dec. 6, 2012

(65) Prior Publication Data

US 2014/0079485 A1 Mar. 20, 2014

(30) Foreign Application Priority Data

May 31, 2011 (CN) ..... 2011 1 0144493

(51) Int. Cl.

| | |
|---|---|
| ***E21D 9/10*** | (2006.01) |
| ***E21B 44/00*** | (2006.01) |
| ***E21D 9/00*** | (2006.01) |
| ***E21D 9/06*** | (2006.01) |
| ***E02D 3/12*** | (2006.01) |

(52) U.S. Cl.

CPC ..... *E21B 44/00* (2013.01); *E21D 9/003* (2013.01); *E21D 9/06* (2013.01); *E02D 3/12* (2013.01); *E21D 9/10* (2013.01)

(58) Field of Classification Search

CPC ..... E02D 3/12; E21B 44/00; E21D 9/003; E21D 9/06; E21D 9/10

USPC ..... 405/138, 141, 142, 145; 702/9

See application file for complete search history.

(56) References Cited

U.S. PATENT DOCUMENTS

| | | | | | |
|---|---|---|---|---|---|
| 5,284,403 | A | * | 2/1994 | Ilomaki | 405/141 |
| 5,312,163 | A | * | 5/1994 | Hanamoto et al. | 299/1.8 |
| 5,443,305 | A | * | 8/1995 | Heierli et al. | 299/33 |
| 5,478,170 | A | * | 12/1995 | Hanamoto et al. | 405/143 |
| 5,749,678 | A | * | 5/1998 | Dose et al. | 405/184 |

(Continued)

*Primary Examiner* — Benjamin Fiorello

(74) *Attorney, Agent, or Firm* — Novoclaims Patent Services LLC; Mei Lin Wong

(57) ABSTRACT

A method for preventing shield jamming by excessive frictional resistance in earth pressure balance shield which involves real-time monitoring of earth pressure signal for earth pressure on the shield body through sensors on the shield machine. Combined with the known parameters, resistance in the shield machine is calculated. The friction $F_1$ between the shield body and the stratum is calculated by CPU module in PLC according to the earth pressure signals on a real-time basis. Then the friction $F_1$ is determined whether it is less than or equal to the difference between the quotient of dividing total propulsion force $F_t$ by correction coefficient Kxz and total resistance of $F_2$, $F_3$, $F_4$ and $F_5$; if so, it is under normal propulsion; if not, the warning device alarms.

5 Claims, 9 Drawing Sheets

(56) References Cited

U.S. PATENT DOCUMENTS

| | | | | |
|---|---|---|---|---|
| 6,017,095 | A * | 1/2000 | DiMillo | 299/56 |
| 6,772,134 | B1 * | 8/2004 | Jacubasch et al. | 706/8 |
| 7,054,750 | B2 * | 5/2006 | Rodney et al. | 702/9 |
| 7,207,396 | B2 * | 4/2007 | Hall et al. | 175/40 |
| 2002/0029908 | A1 * | 3/2002 | Bloom et al. | 175/99 |
| 2009/0297273 | A1 * | 12/2009 | Lindbergh et al. | 405/138 |
| 2010/0086359 | A1 * | 4/2010 | Saleniemi | 405/138 |
| 2010/0126770 | A1 * | 5/2010 | Sugiura | 175/38 |

* cited by examiner

METHOD FOR PREVENTING SHIELD CASING JAMMING DUE TO TOO LARGE FRICTIONAL RESISTANCE IN EARTH PRESSURE BALANCE SHIELD MACHINE

CROSS REFERENCE OF RELATED APPLICATION

This is a national phase national application of an international patent application number PCT/CN2011/075493 with a filing date of Jun. 9, 2011, which claimed priority of a foreign application number 201110144493.2 with a filing date of May 31, 2011 in China. The contents of these specifications, including any intervening amendments thereto, are incorporated herein by reference.

BACKGROUND OF THE PRESENT INVENTION

1. Field of Invention

The present invention relates to the technical field of tunnel engineering, and more particularly to a method for preventing shield jamming due to too large frictional resistance in an earth pressure balance shield machine.

2. Description of Related Arts

During a tunneling process by a shield machine, the occurrence of shield-jamming which causes the inability of forward movement of the cutting disk is not uncommon. When there is changes of formation pressure, the friction between the shield body of the shield machine and the stratum may become too large and lead to the occurrence of shield-jamming. When this kind of construction failure occurs in which the machine is forced to shut down, a very long period of time and a very high cost are required to resolve the problem. For example, auxiliary pilot tunnel is excavated or controlled blasting method is employed to solve the problem, which is labor intensive, time consuming and costly. At present, there is no article about how to prevent the problem of shield jamming due to excessive friction in our nation or abroad.

SUMMARY OF THE PRESENT INVENTION

An object of the present invention is to provide a method for preventing shield-jamming due to excessive friction in an earth pressure balance shield machine with a method for real-time monitoring and alert to the friction of a shield casing, thus pretreatment engineering measures can be timely employed to avoid a construction failure which requires the shut down of shield machine.

According to the present invention, the foregoing and other objects and advantages are attained by the followings:

A method of preventing shield jamming caused by excessive friction in an earth pressure balance shield machine comprises the steps of:

(1) carrying out real-time monitoring for an earth pressure signal between a shield body and a stratum through an earth pressure sensor arranged on a casing of the shield machine;

(2) combining the known parameters of the shield machine and geological parameters of construction, calculating the total propulsion force $F_t$ of a propulsion oil cylinder of the shield machine, the head friction $F_2$ of a cutting disk of the shield machine, the friction $F_3$ between a tail seal of the shield machine and a pipe sheet, the friction $F_4$ between a wheel set of a backup trailer and steel rails, and the axial component force $F_5$ produced by water and earth pressure acted on a cutter when the cutting disk has a cutting action;

(3) inputting the total propulsion force $F_t$ of a propulsion oil cylinder of the shield machine, the head friction $F_2$ of a cutting disk of the shield machine, the friction $F_3$ between a tail seal of the shield machine and a pipe sheet, the friction $F_4$ between a wheel set of a backup trailer and steel rails, and the axial component force $F_5$ produced by water and earth pressure acted on a cutter when the cutting disk has a cutting action together with a correction coefficient Kxz into a CPU module of a PLC through a programming device; and simultaneously inputting the earth pressure signal detected by the earth pressure sensor into the CPU module through an input module; calculating the friction $F_1$ between the shield body and the stratum based on the earth pressure signal detected by the earth pressure sensor; and finally determining whether the friction $F_1$ between the shield body and the stratum is less than or equal to the difference between the quotient of dividing the total propulsion force $F_t$ of the propulsion oil cylinder of the shield machine by the correction coefficient Kxz and the total resistance of $F_2+F_3+F_4+F_5$; if the answer is yes, then the shield machine is determined to have a normal condition; if the answer is no, then an alert device is triggered to shut down the shield machine while engineering measures for pretreatment of stratum, auxiliary engineering measures or the both are employed to prevent shield-jamming and forced shut down of the shield machine.

According to the present invention, the engineering measures for pretreatment of stratum refers to reinforcement of the stratum by injection of grout into the stratum.

Preferably, when performing injection of grout into the stratum, permeation grouting is employed if the stratum is a gravel sediments layer and the grouting materials includes aqueous solution of waterglass-sodium aluminate grout (sodium silicate-sodium aluminate grout), modified waterglass (modified sodium silicate), Portland cement-waterglass grout and ultrafine cement-waterglass grout, compaction or fracture grouting is employed if the stratum is a clay layer and the grouting materials includes a cement-loess-fly ash grout, cement-waterglass double grout and cement-sand-fly ash grout.

Preferably, the auxiliary engineering measures include at least one of the followings: casting of bentonite grout into the stratum to provide a lubricating effect; and temporarily increasing a pressure of an overflow valve of a hydraulic system of the shield machine.

According to the present invention, a system of preventing shield-jamming caused by excessive friction in an earth pressure balance shield machine comprises a data acquisition module, an input module, a CPU module, an output module and an alert device; wherein the data acquisition module comprises at least four earth pressure sensors arranged on a casing of a shield machine through which the earth pressure signal around a shield body is collected on a real-time basis; the data acquisition module is connected with the CPU module through the input module such that the earth pressure signal collected by the earth pressure data acquisition module is transmitted to the CPU module through the input module; the CPU module calculates the friction $F_1$ between the shield body and the stratum based on the pressure signal transmitted by the earth pressure sensor, and ultimately determines whether the friction $F_1$ between the shield body and the stratum is less than or equal to the difference between the quotient of dividing the total propulsion force $F_t$ of the propulsion oil cylinder of the shield machine by the correction coefficient Kxz and the total friction of $F_2+F_3+F_4+F_5$; if the answer is yes, then the shield machine is determined to have a normal condition and propels normally; if the answer is no, then the output module output an alert signal to trigger the alert device.

The present invention is further described in details as follows:

When the shield machine have a normal condition and propels normally, the shield machine is acted by a plurality of resistance forces including the friction between a shield body 3 and a stratum 4, the head resistance of a cutting disk 55 of the shield machine, the friction between a tail seal 6 of the shield machine and a pipe sheet 7, the friction between a wheel set 8 of a backup trailer 10 and steel rails 9, and the axial component force $F_5$ produced by water and earth pressure acted on a cutter when the cutting disk 55 has a cutting action, wherein the biggest resistance force is the friction between the shield body 3 and the stratum 4, which is about 65% of the total resistance force.

If $F_t \geq F_z$, the shield machine is capable of propelling normally, and this formula is the conditions for the shield machine to propel normally, that is:

$$F_t \geq K_{xz} F_z \quad (1)$$

where:

$F_t$—the total propulsion force of a propulsion oil cylinder 5 of the shield machine;

$K_{xz}$—the correction coefficient (greater than 1, take 1.05, may be adjusted according to different geological conditions of the construction and construction experience);

$F_z$—the total resistance force of the shield machine when the shield machine is having a propulsion action;

$$F_z = F_1 + F_2 + F_3 + F_4 + F_5 \quad (2)$$

where:

$F_1$—the friction resistance between the shield body 3 and the stratum 4;

$F_2$—the head resistance of a cutting disk 55 of the shield machine, that is, the earth and water pressure acting on a front excavation surface of the shield machine;

$F_3$—the friction between the tail seal 6 of the shield machine and a pipe sheet 7;

$F_4$—the friction between a wheel set 8 of a backup trailer 10 and steel rails 9; and $F_5$—the axial component force produced by water and earth pressure acted on a cutter 56 when a cutting disk 55 have a cutting action.

Substitute Formula (2) into Formula (1), the following relation can be obtained:

$$F_1 \leq F_t / K_{xz} - (F_2 + F_3 + F_4 + F_5) \quad (3)$$

Formula (3) indicates that: if the friction resistance $F_1$ between the shield body 3 and the stratum 4 is less than or equal to the difference between the quotient of dividing the total propulsion force $F_t$ of the propulsion oil cylinder of the shield machine by the correction coefficient $K_{xz}$ and the total resistance of $F_2+F_3+F_4+F_5$, the shield machine can propel normally, wherein $$F_t = P_t \times \pi d^2 / 4 \times n \quad (4)$$

where:

$P_t$—the set pressure of a hydraulic propulsion system, $KN/m^2$;

d—the inner diameter of the propulsion oil cylinder 5, m;

n—the number of the propulsion oil cylinders; and the $P_t$, d and n in the Formula (4) are all known conditions and the total propulsion force $F_t$ of the propulsion oil cylinder of the shied machine may be obtained.

$$F_2 = \pi D^2 / 4 \times (\theta_{fe1} + \theta_{fw1} + \theta_{fe2} + \theta_{fw2}) / 2 \quad (5)$$

where:

D—the outer diameter of a cutting disk 55, m;

$\theta_{fe1}$—the earth pressure on the top portion of the cutting disk 55, $KN/m^2$;

$\theta_{fe2}$—the earth pressure on the bottom portion of the cutting disk 55, $KN/m^2$;

$\theta_{fw1}$—the water pressure on the top portion of the cutting disk 55, $KN/m^2$;

$\theta_{fw2}$—the water pressure on the bottom portion of the cutting disk 55, $KN/m^2$;

in the Formula (5), D is known, and $\theta_{fe1}$, $\theta_{fe2}$, $\theta_{fw1}$ and $\theta_{fw2}$ can be obtained through the parameters provided in a construction document and a geological document and are known conditions. Therefore, the head resistance $F_2$ of the cutting disk 55 of the shield machine can be obtained.

$$F_3 = n_s \times W_s \times \mu_s \quad (6)$$

where:

$n_s$—the number of rings (generally 2~3) of inner pipe sheet 7 in a shield tail 11 (a part of the shield body 3);

$W_s$—the weight of each ring of a pipe sheet, KN;

$\mu_s$—the friction coefficient (generally 0.3~0.5) between the tail seal 6 of the shield machine and the pipe sheet 7;

in the formula (6), $n_s$, $W_s$ and $\mu_s$ are all known conditions and the friction $F_3$ between the tail seal 6 and the pipe sheet 7 can be obtained.

$$F_4 \mu \times G_t \quad (7)$$

where:

μ—the friction coefficient (generally 0.1) between a wheel set 8 of a backup trailer 10 and steel rails 9;

$G_t$—the weight of the backup trailer 10, KN;

in the formula (7), μ and $G_t$ are known conditions and the friction $F_4$ of the traction of the backup trailer 10 can be obtained.

$$F_5 = A_{exc} \times K \times P_{w1} \quad (8)$$

where:

$A_{exc}$—the total area of a pressured cutting surface of a cutter 56, $m^2$;

K—water and earth pressure coefficient (generally 0.45~0.5);

$P_{w1}$—the vertical water and earth pressure acting on the cutting disk 56, $KN/m^2$;

in the formula (8), K is known, $A_{exc}$ can be obtained based on the parameters provided in an equipment document, $P_{w1}$ can be obtained based on the parameter provided in a construction geological document and therefore all of them are known conditions. Therefore, the axial component force $F_5$ acting on the cutter 56 can be obtained.

$$F_1 = \mu_1 \times \pi \times E \times L_m \times (P_{e1} + \theta_{ez} + \theta_{ey} + P_{e2} + P_g) / 4 \quad (9)$$

where:

$\mu_1$—the friction coefficient between a stratum 4 and a shield body 3 (generally 0.3);

D—the outer diameter of a shield body 3, m;

$L_m$—the length of a shield body 3, m;

$P_{e1}$—the vertical water and earth pressure acting on the upper part of the shield body 3, $KN/m^2$;

$\theta_{e1z}$—the water and earth pressure acting on the left upper part of the shield body 3 in a horizontal direction, $KN/m^2$;

$\theta_{e2z}$—the water and earth pressure acting on the left lower part of the shield body 3 in a horizontal direction, $KN/m^2$;

$\theta_{e1y}$—the water and earth pressure acting on the right upper part of the shield body 3 in a horizontal direction, $KN/m^2$;

$\theta_{e2y}$—the water and earth pressure acting on the right lower part of the shield body 3 in a horizontal direction, $KN/m^2$;

$\theta_{ez}$—the water and earth pressure acting on the left and middle part of the shield body 3 in a horizontal direction, which is the arithmetic average value of $\theta_{e1z}$ and $\theta_{e2z}$, KN/m$^2$;

$\theta_{ey}$—the water and earth pressure acting on the right and middle part of the shield body 3 in the horizontal direction, which is the arithmetic average value of $\theta_{e1y}$ and $\theta_{e2y}$, KN/m$^2$;

$P_{e2}$—the vertical water and earth pressure acting on the lower part of the shield body 3, KN/m$^2$;

$P_g$—the ground pressure between the shield body 3 and a stratum 4 produced by the weight of the shield machine itself, KN/m$^2$;

in the formula (9), $\mu_1$, D and $L_m$ are known conditions, $P_{e1}$ can be detected through an earth pressure sensor 21 arranged on a top portion the shield body 3, $\theta_{ez}$ can be detected through an earth pressure sensor 23 arranged on the left and middle part of the shield body 3, $\theta_{ey}$ can be detected through an earth pressure sensor 24 arranged on the right and middle part of the shield body 3, and $P_{e2}+P_g$ can be detected through an earth pressure sensor 22 arranged on the bottom portion of the shield body 3. Therefore, the friction $F_1$ between the shield body 3 and the stratum 4 can be obtained. The earth pressure sensors 21, 23, 24 and 22 are connected to an input module of a PLC through an armored signal cable.

Formula (3) is a determining formula through which whether the shield machine meets normal propulsion conditions can be determined. The method comprises the steps of: inputting $F_t$, $F_2$, $F_3$, $F_4$, $F_5$ and $K_{xz}$, which are calculated in advance, into a CPU module of a PLC through a programming device, simultaneously inputting the pressure signals $P_{e1}$, $\theta_{ez}$, $\theta_{ey}$ and $P_{e2}+P_g$ detected by the earth pressure sensors 21, 23, 24 and 22 into the CPU module of the PLC through the armored signal cable and the input module of the PLC, carrying out calculation and comparison process, if the determining conditions of formula (3) is not met, sending an alert signal through a an alert device which is triggered through the output module of the PLC such that site engineers and construction personnel is timely alerted to stop the shield machine and carry out stratum pretreatment engineering measures or other auxiliary engineering measures, thus avoiding the forced shut down fault of the shield machine due to shield jamming.

According to the present invention, the pretreatment engineering measures includes reinforcing the stratum 4 by grouting into the stratum 4, thus preventing the stratum 4 from being loose and hence causing the load acted on the shield body 3 to be increased. As to other auxiliary engineering measures, bentonite grout is casted into the stratum 4 to carry out lubrication and may reduce the friction resistance between the stratum 4 and the shield body 3. At the same time, it also may temporarily increase the pressure of opening of an overflow valve 52 of a hydraulic system propelled by the shield machine and reduce the pressure storage of a propulsion oil cylinder 5, thus obtaining the greater total propulsion force $F_t$ in a short time. When the adjustment is carried out, the limit of adjustment is the rated pressure of the propulsion oil cylinder.

The process of grouting into the stratum 4 is completed through the compatible elements of a reserved pore path 31, a jumbolter 34, a grout-storage tank 36 and a grout pump 35 on the shielding casing of the shield machine. First, a protecting cover 32 on the reserved pore path 31 is unscrewed; second, a hollow anchor rod 33 is driven by a jumbolter 34 to enter the stratum 4 through the reserved pore path 31 and; and finally, a prepared grout fluid in a grout-storage tank 36 is casted into the stratum 4 through a grout casted pipe 37 (only one part is shown in the figure) by the grout pump 35.

The jumbolter 34 is used as the drilling equipment. Other drilling equipment such as a geological drilling machine and other engineering drilling machine can also be used as the drilling equipment.

The equipment and process of casting bentonite grout into the stratum 4 are the same as the above process of grouting except that bentonite is used.

According to a preferred embodiment of the present invention, the existing shield machine (such as the shied machine model CTE6280 manufactured and sold by the China Railway Tunneling Equipment Co., Ltd. or an existing shield machine with similar structure) is employed. Four earth pressure sensors are installed at absolute top, absolute bottom, absolute left (left-middle) and absolute right (right-middle) positions of the shield casing of the shield machine respectively. The earth pressure sensors are connected to an input module in a PLC through an armored signal cable. The reserved grout port path 31 is distributed circumferentially along the circumference of the shield body 3 of the shied machine. A plurality number of grout port paths, such as 4, 6 or 8 gout port paths, is arranged based on the requirement and the space available.

According to the present invention, the calculation and control system is completed based on a PLC.

The above calculation formulas for $F_1$, $F_2$, $F_3$, $F_4$ and $F_5$ is referred to the information in earth pressure balance shield machine (soft soil) provided by the Urban Construction Industry Standard of the People's Republic of China CJ/T284-2008-ϕ5.5 m~ϕ7 m.

According to the present invention, the earth pressure sensors are arranged on the shield body such that the method of carrying out real-time monitoring for the friction resistance of the shield body is easy and simple, thus effectively avoiding the shield machine fault of forced shut down due to shield body jamming. Accordingly, the construction risk is lowered and the construction efficiency is increased.

THE DESCRIPTION OF NUMBERS USED IN THE FIGURES

Figure 1:
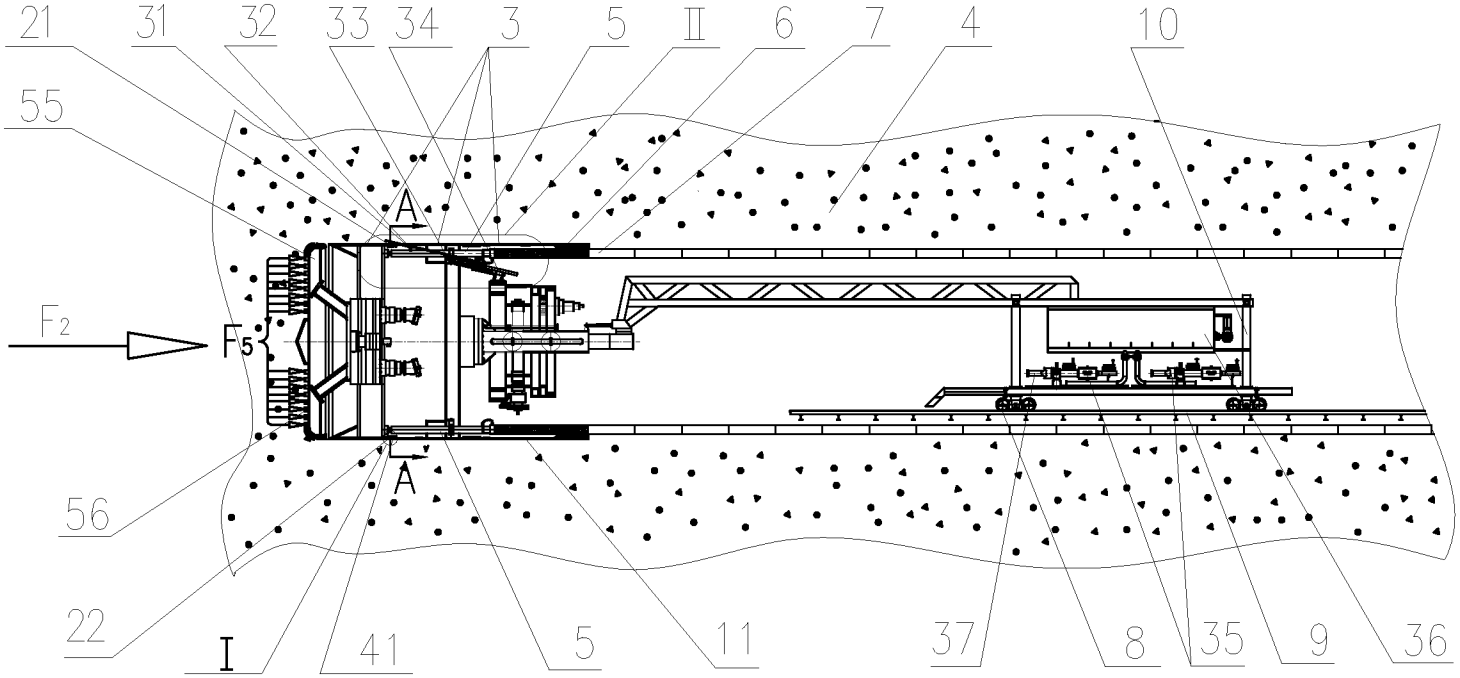
FIG. 1 is a partial structural illustration of an earth pressure balance shield machine which is suitable for use for the present invention.
Figure 2:
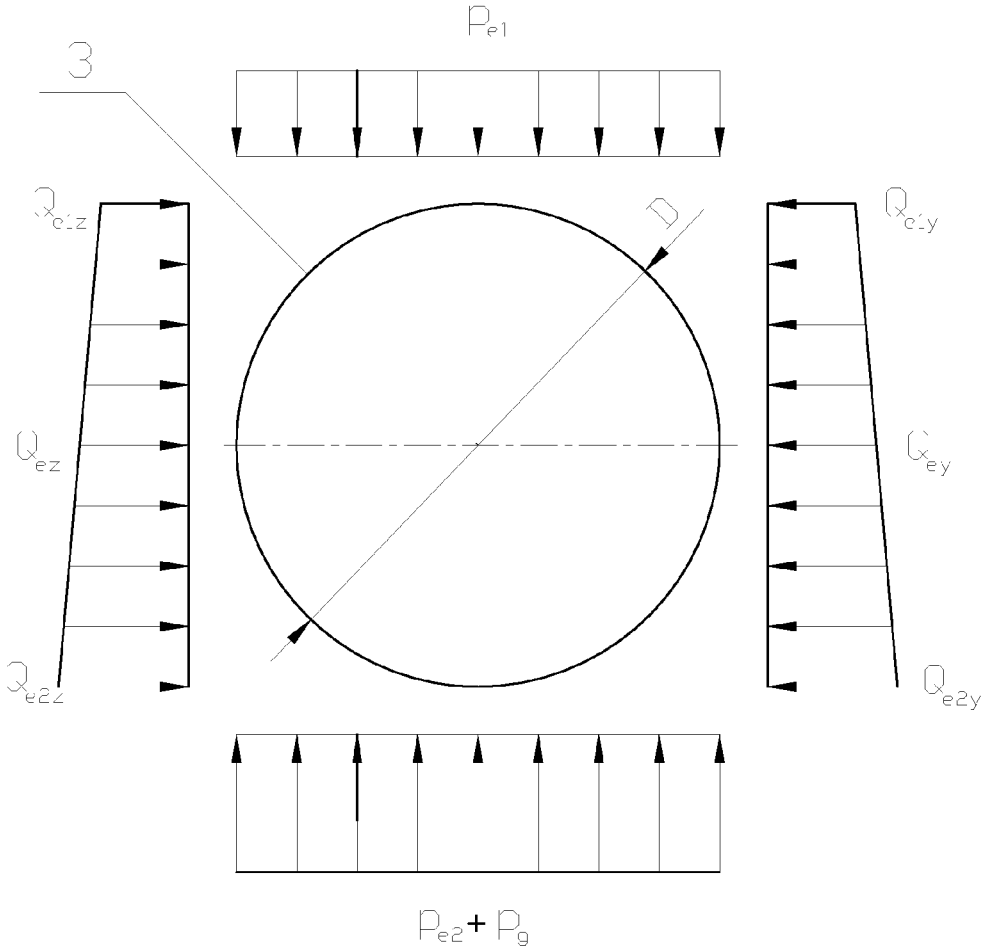
FIG. 2 is an illustration of the load distribution in the periphery of a shield body exerted by water and earth pressure.
Figure 3:
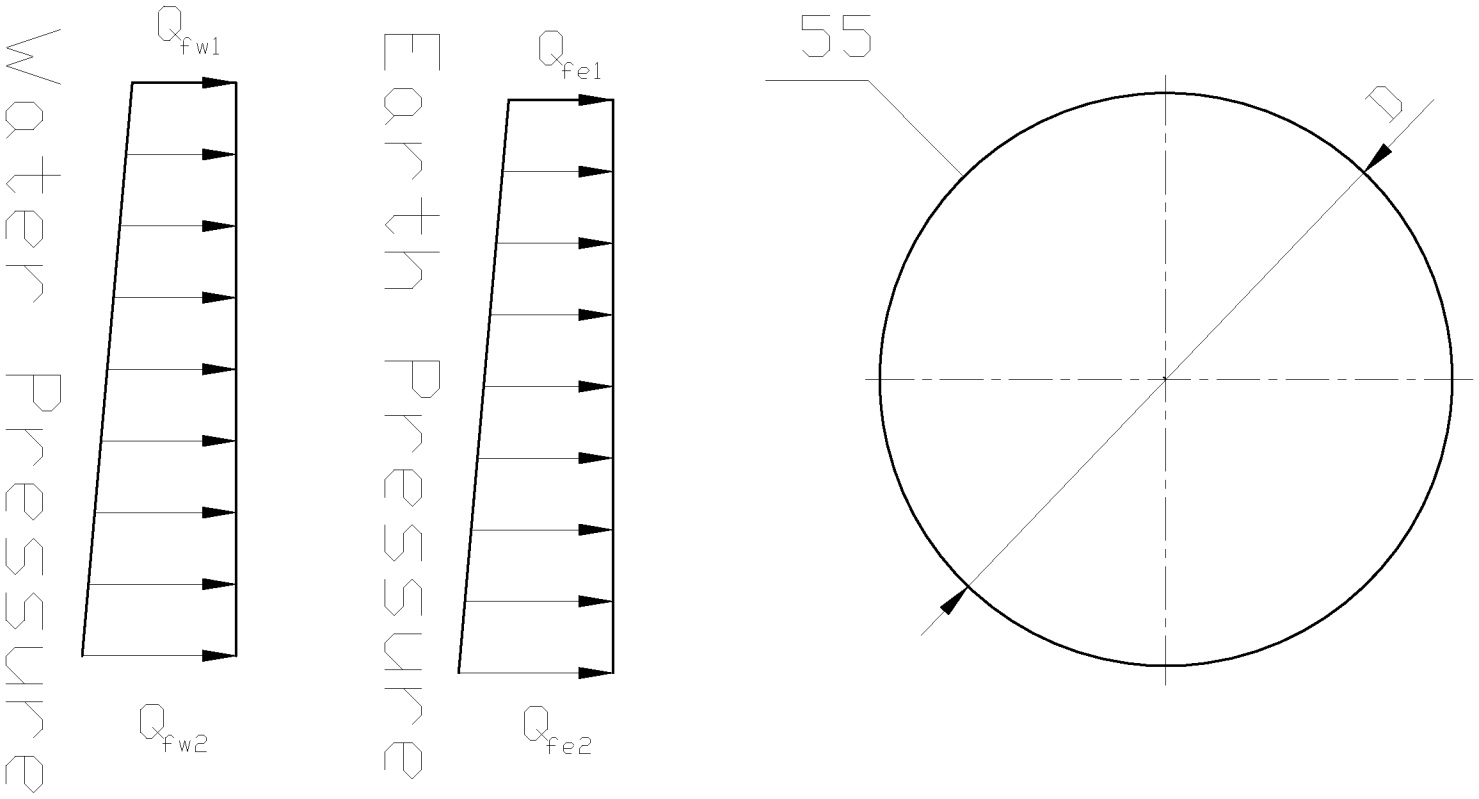
FIG. 3 is an illustration of the load distribution of the right side of a cutting disk of a shield machine.
Figure 4:
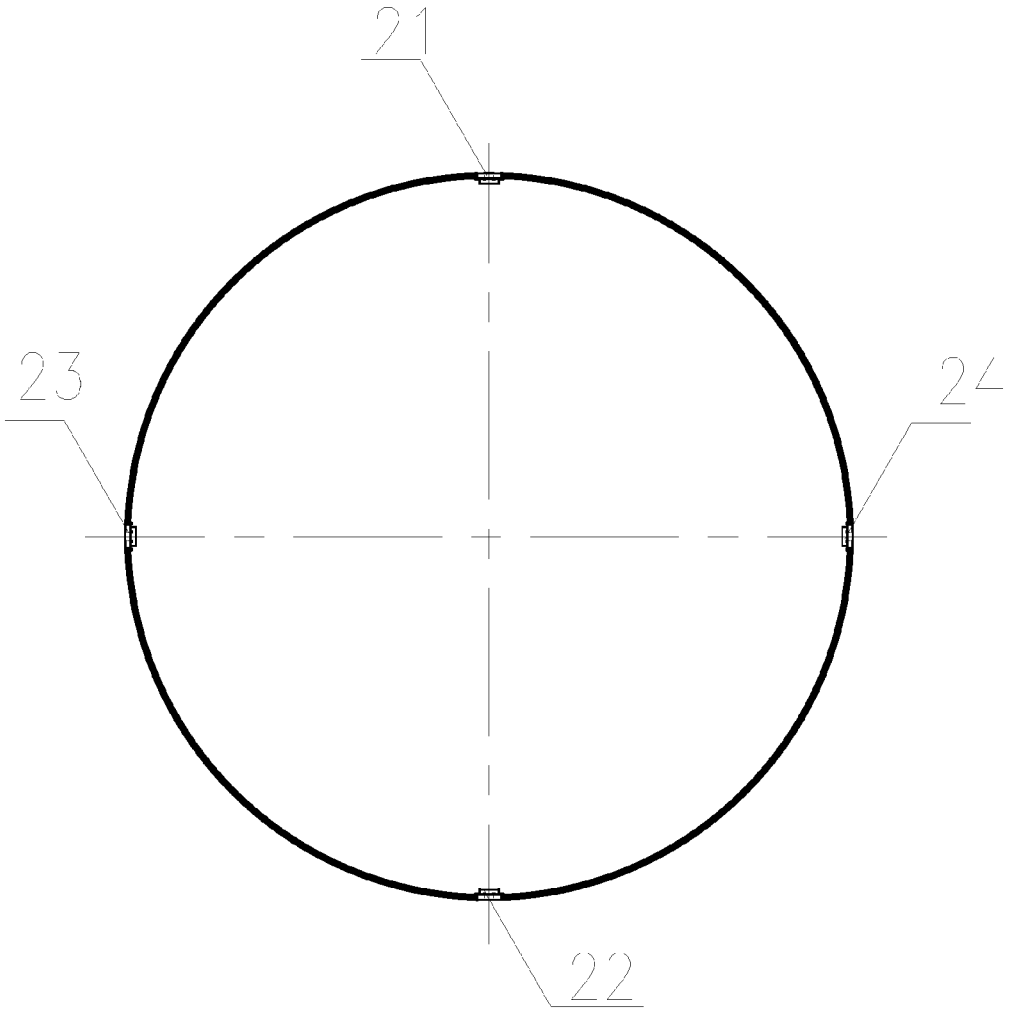
FIG. 4 is an A-A sectional view of FIG. 1—an illustration of the position of earth pressure sensors.

3: Shield Body; 4: Stratum; 5: Propulsion Oil Cylinder: 6: Tail Seal (of the shield machine); 7: Pipe Sheet; 8: Wheel Set; 9: Steel Rails: 10: Backup Trailer: 11: Tail Portion (of the Shield Machine): 21: Earth Pressure Sensor located at a top position; 22: Earth Pressure Sensor located at a bottom position; 23: Earth Pressure Sensor located at a Left-Middle position; 24: Earth Pressure Sensor located at a Right-Middle position; 31: Reserved Pore Path: 32: Protecting Cover; 33: Hollow Anchor Rod; 34: Jumbolter; 35: Grout Pump. 36: Grout-Storage Tank; 37: Grout Casted Pipe; 52: Overflow Valve; 55: Cutting Disk: 56: Cutter

DETAILED DESCRIPTION OF THE PREFERRED EMBODIMENT

Embodiment 1

The stratum of a test block of XX city subway engineering with the mileage of K24+105.125~K25+173.149 is a sedimentary formation interacted with sand soil and conglomerate: natural severe $\gamma$=19.0 KN/m$^3$, void ratio e=0.74, natural moisture content w=5.0%, the compression factor $\alpha$=0.72, internal friction angle $\phi$=22°, cohesion c=39 KPa, permeability coefficient k=1.9×10−2 cm/s.

An earth pressure balance shield machine with an diameter of $\phi$6250 mm is used for excavation (tunneling). During the process of the tunneling, real-time monitoring and warning of the friction between the shield body and a stratum are carried out through earth pressure sensors, a PLC controller and a warning device (an alert device) arranged on a shield body. The earth pressure signals and the related data which are collected at the position with the tunneled mileage of K24+536.235 are calculated as follows: based on formula (3), determine whether the friction $F_1$ between the shield body and the stratum is less than or equal to the difference between the quotient from the total propulsion force $F_t$ of the propulsion oil cylinder of the shield machine divided by the correction coefficient $K_{xz}$ and the total resistance of F2+F3+F4+F5. If the condition of formula (3) is met, then the shield machine is determined to have a normal condition and propels normally.

The set pressure $P_t$ of a hydraulic propulsion system is 25000 KN/m$^2$; the inner diameter of a propulsion oil cylinder d is 0.22 m; and the number n of the propulsion oil cylinder is 30. According to Formula (4), the total propulsion force Ft of the propulsion oil cylinder is calculated, which is equal to 28495.5 KN.

The outer diameter of the cutting disk of the shield machine D=6.25 m; the top earth pressure $\theta_{fe1}$=268 KN/m$^2$; the bottom earth pressure $\theta_{fe2}$=338 KN/m$^2$; the top water pressure $\theta_{fw1}$=193 KN/m$^2$; the bottom water pressure $\theta_{fw2}$=282 KN/m$^2$, and according to Formula (5), the positive resistance $F_2$ of the cutting disk of the shield machine is calculated to be 16573.9 KN.

The number of rings of a pipe sheet in a tail portion (of the shield machine) $n_s$=2.5; the weight of each pipe sheet $W_s$=225 KN; and the friction coefficient between a tail seal and the pipe sheet $\mu_s$=0.4, and according to Formula (6), the friction resistance $F_3$ between the tail seal and the pipe sheet is calculated to be 225 KN.

The friction coefficient between a wheel set of a backup trailer and steel rails $\mu$=0.1; the weight of the backup trailer $G_t$=2500 KN, and according to Formula (7), the head resistance $F_4$ of the traction of the backup trailer is calculated to be 250 KN.

The total area of the pressed cutting face of a cutter $A_{exc}$=0.64 m$^2$; the water and earth pressure coefficient K=0.45; and the vertical water and earth pressure acted on the cutting disk $P_{w1}$=237.5 KN/m$^2$; and according to formula (8), the axial component force $F_5$ acted on the cutter is calculated to be 68.4 KN.

The friction coefficient between the stratum and the shield body $\mu_1$=0.3; the outer diameter of the shield body D=6.25 m; the length of the shield body $L_m$=7.25 m; the vertical water and earth pressure acted on the top part of the shield body and measured by an earth pressure sensor 21 $P_{e1}$=186 KN/m$^2$; the sum of the vertical water and earth pressure $P_{e2}$ acted on the bottom part of the shield body and measured by an earth pressure sensor 22 and the ground pressure ratio $P_g$ between the shield body and the stratum caused by its weight $P_{e2}$+$P_g$=254 KN/m$^2$; the water and earth pressure acted in the horizontal direction at the left-middle part of the shield body and measured by the water and earth sensor 23 $\theta_{ez}$=210 KN/m$^2$; the water and earth pressure acted in the horizontal direction at the right-middle part of the shield body and measured by the water and earth sensor 24 $\theta_{ey}$=192 KN/m$^2$, and according to Formula (9), the friction resistance $F_1$ between the shield body and the stratum is calculated to be 8984.1 KN.

$$F_t/K_{xz}-(F_2+F_3+F_4+F_5)=28495.5/1.05-(16573.9+225+250+68.4)=10021.3\ \text{KN}$$

According to the abovementioned calculated results, it is determined that $F_1 \leq$Ft/Kxz−(F2+F3+F4+F5), which indicates that the determining condition of formula (3) is fulfilled. Accordingly, the shield machine is proved to have a normal condition and propelled normally, and the warning device (the alert device) is not triggered at this time.

Figure 5:
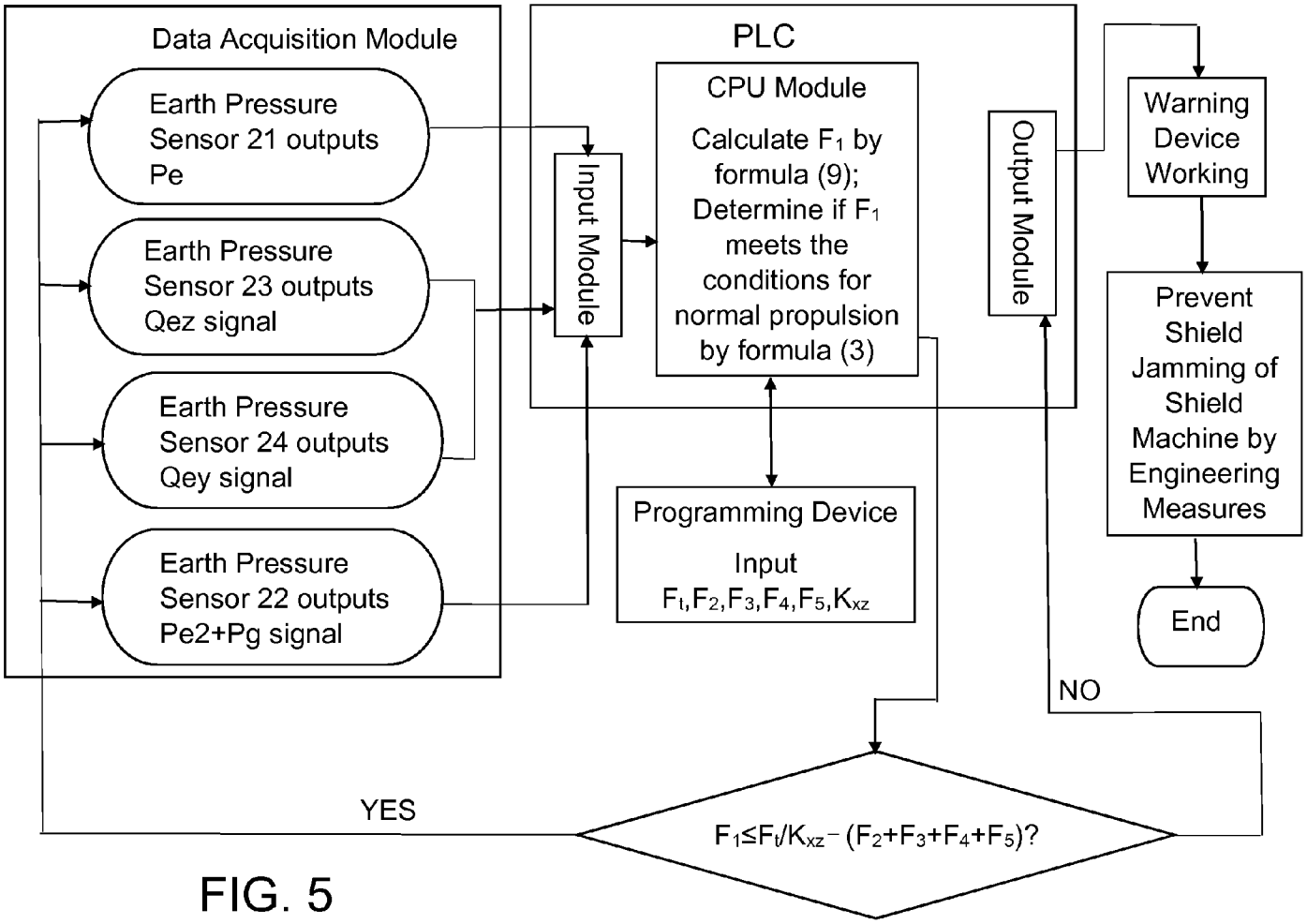
FIG. 5 is a schematic diagram of the working principle of avoiding shield body jamming problem.
Figure 6:
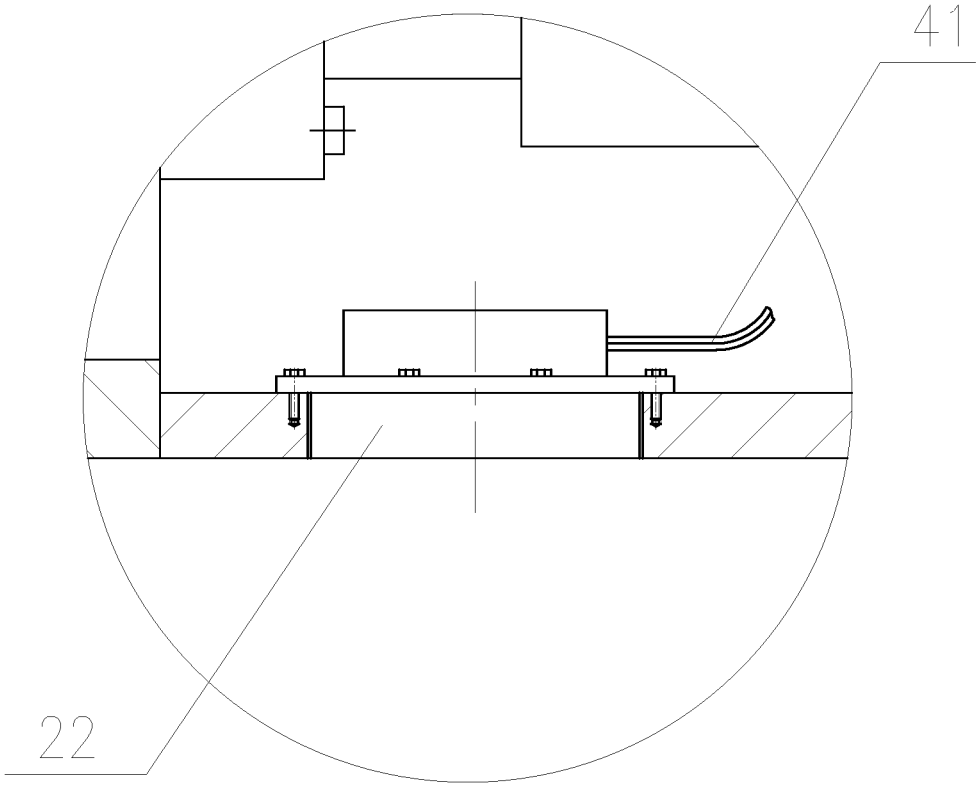
FIG. 6 is a partial enlarged view of I in FIG. 1.
Figure 7:
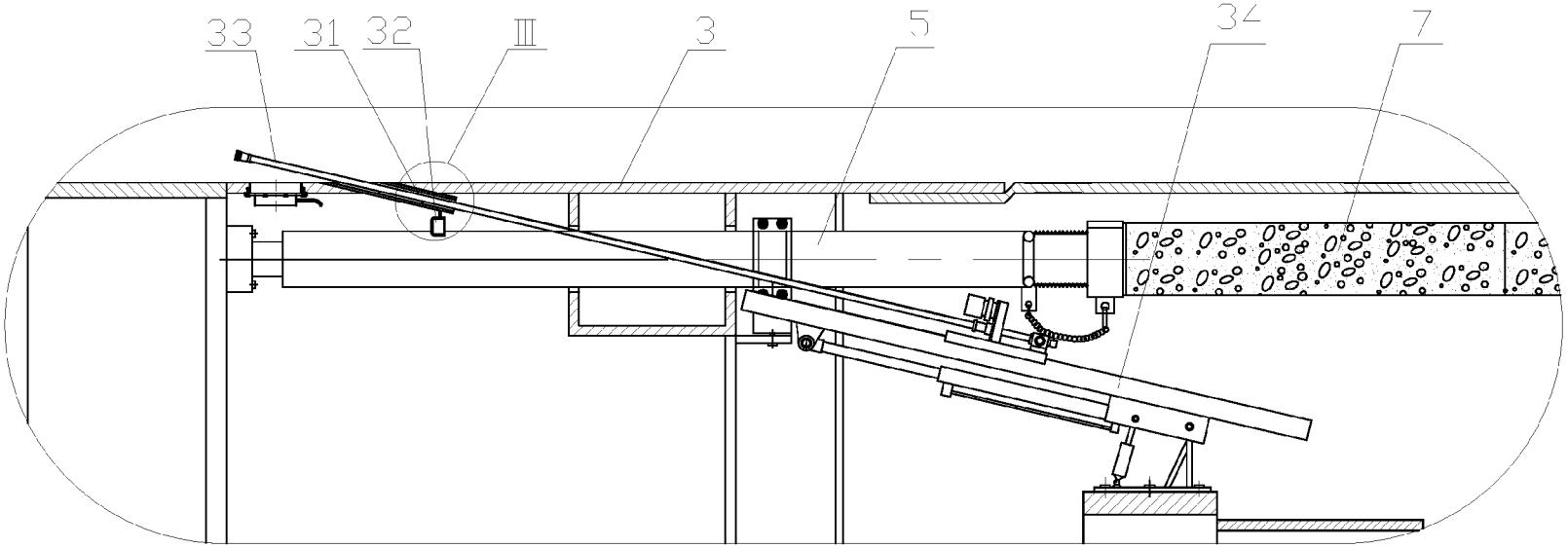
FIG. 7 is a partial enlarged view of II in FIG. 1.
Figure 8:
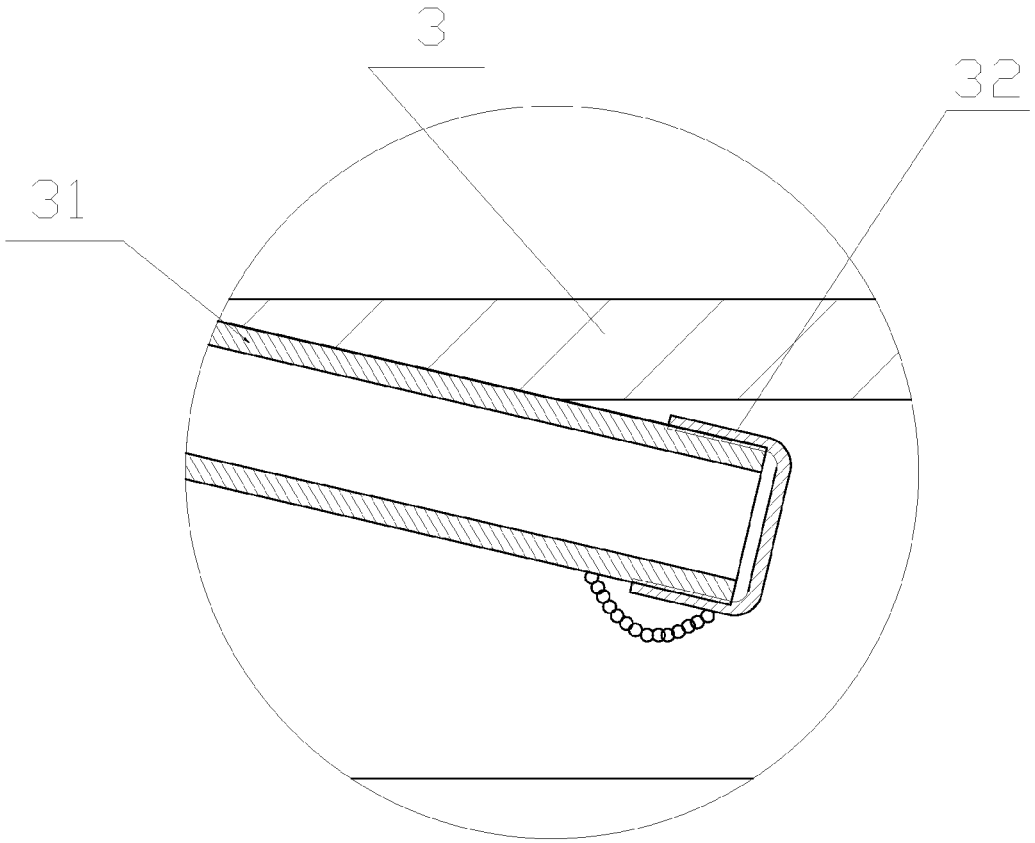
FIG. 8 is a partial enlarged view of III in FIG. 7.
Figure 9:
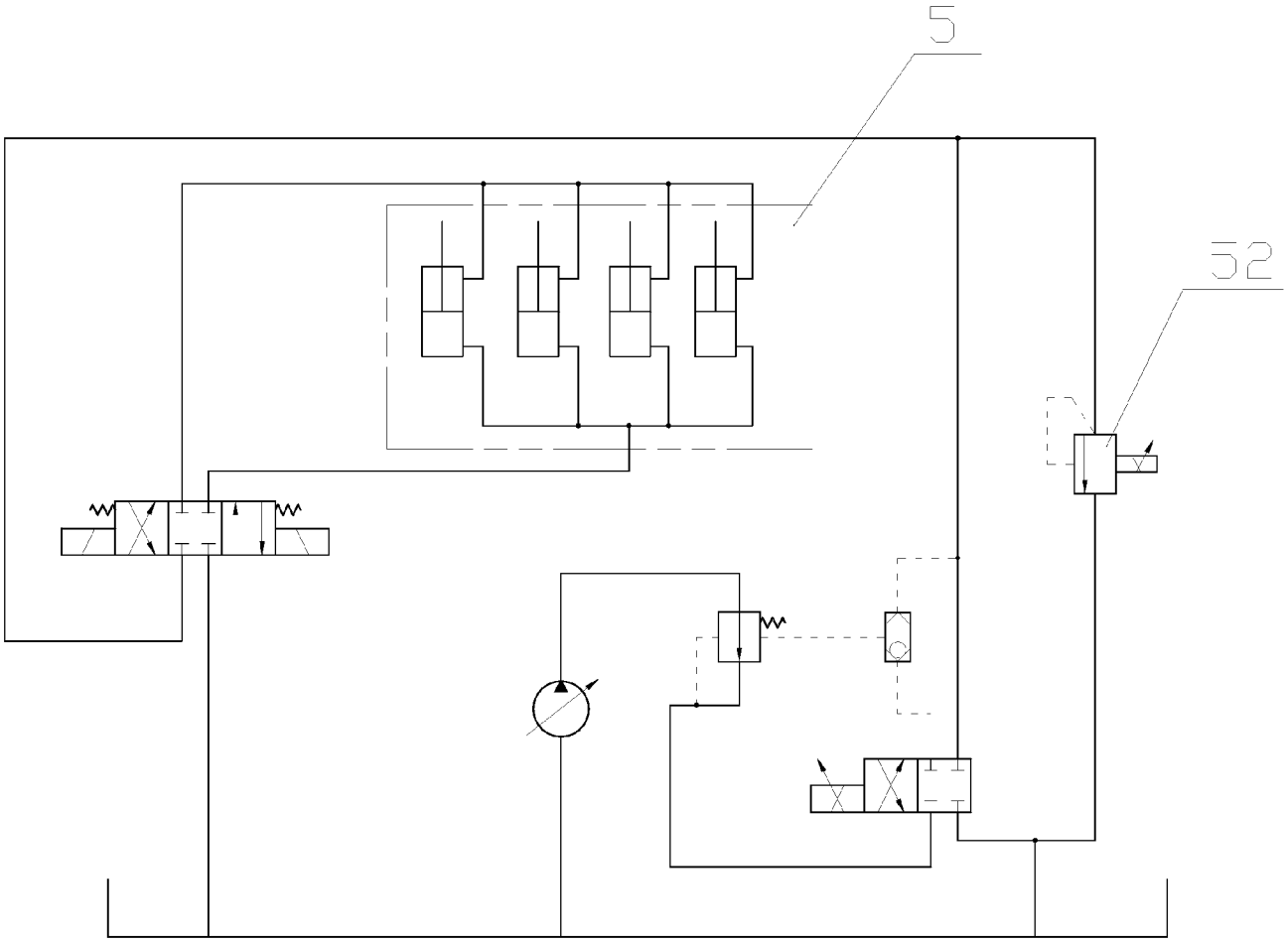
FIG. 9 is an illustration of the principle of hydraulic pressure of a propulsion system of a shield machine.

It is worth mentioning that the calculation process, the determining process and the control process are all automatically completed through a PLC. See FIG. 5.

The process of earth pressure signal collection, calculation and control are repeated continuously through the earth pressure sensor, the PLC and the warning device during the process of tunneling in which the shield machine is having forward propulsion action.

Embodiment 2

The construction is the same as that of Embodiment 1.

The followings are known: Pt=25000 KN/m$^2$, d=0.22 m, n=30, $F_t$=28495.5 KN; D=6.25 m, $\theta_{fe1}$=268 KN/m$^2$, $\theta_{fe2}$=338 KN/m$^2$, $\theta_{fw1}$=193 KN/m$^2$, $\theta_{fw2}$=282 KN/m$^2$, $F_2$=16573.9 KN; $n_s$=2.5, $W_s$=225 KN, $\mu_s$=0.4, $F_3$=225 KN; $\mu$=0.1, $G_t$=2500 KN, $F_4$=250 KN; $A_{exc}$=0.64 m$^2$, K=0.45, $P_{w1}$=237.5 KN/m$^2$, $F_5$=68.4 KN; and $\mu_1$=0.3, $L_m$=7.25 m.

When the tunneling mileage of the shield machine is at K25+055.142, the warning device is triggered to send out an alert signal in the form of an audio and lighting warning signal. At this time, the pressure measured by the earth pressure sensors 21, 22, 23 and 24 are $P_{e1}$=218 KN/m$^2$, $\theta_{ez}$=235 KN/m$^2$, $\theta_{ey}$=228 KN/m$^2$ and $P_{e2}$+$P_g$=265 KN/m$^2$ respectively.

According to Formula (9), the friction resistance $F_1$ between the shield body and the stratum is calculated to be 10093.82 KN.

$$F_t/K_{xz}-(F_2+F_3+F_4+F_5)=28495.5/1.05-(16573.9+225+250+68.4)=10021.3\ \text{KN}$$

According to the abovementioned calculated results, it is determined that $F_1$>Ft/Kxz−($F_2$+$F_3$+$F_4$+$F_5$), which indicates that the determining condition of formula (3) is not fulfilled. Accordingly, the shield machine is proved to fail to propel normally.

At this time, the engineering measures for pretreatment of stratum should be carried out. This method of pretreatment of stratum includes the step of performing permeation grouting to the stratum around the peripheral area of the shield body such that the stratum is reinforced. The step for permeation grouting is the same as the description provided above.

The grouting material is portland cement-waterglass double grout, wherein the portland cement is type 525 ordinary portland cement, the modulus M and concentration of waterglass are 2.7 and 51° Be' respectively. The water-cement ratio W:C=1:1 (by weight); the ratio of cement and waterglass C: S=1:1 (by volume); the gel time is 55 s; the slurry diffusion radius R=0.9 m; the slurry flow rate q=35 L/min; the injection pressure p=1.2 MPa.

As the grouting process is carried out, the pressure measured by the earth pressure sensors decreases gradually. When the pressure decreases to the level at which the friction $F_1$ between the shield body and the stratum is calculated to be $F_1 \leq 10021.3$ KN according to Formula (9), the warning device stops sending alert signal. This indicates that the shield machine is under normal condition and can propel normally. In this embodiment, the pressure values measured by the earth pressure sensors after the grouting process are $P_{e1}$=209 KN/m$^2$, $\theta_{ez}$=230 KN/m$^2$, $\theta_{ey}$=227 KN/m$^2$ and $P_{e2}+P_g$=275 KN/m$^2$ respectively. The above values are substituted into Formula (9) to obtain the friction resistance $F_1$ between the shield body and the stratum, which is calculated to be 9144.19 KN and is smaller than 10021.3 KN. Accordingly, the shield machine is resumed to have a normal condition and propel normally.

It is worth mentioning that the calculation process, the determining process and the control process are all automatically completed through a PLC. See FIG. 5.

According to this embodiment, the opening pressure of the overflow valve 52 can be increased to increase the total propulsion force Ft of the propulsion oil cylinder 5 from 10021.3 KN to a value which is greater than or equal to 10093.82 KN so that the shield machine can work normally.

Embodiment 3

The construction is the same as that of Embodiment 1

The followings are known: $P_t$=25000 KN/m$^2$, d=0.22 m, n=30, $F_t$=28495.5 KN; D=6.25 m, $\theta_{fe1}$=268 KN/m$^2$, $\theta_{fe2}$=338 KN/m$^2$, $\theta_{fw1}$=193 KN/m$^2$, $\theta_{fw2}$=282 KN/m$^2$, $F_2$=16573.9 KN; $n_s$=2.5, $W_s$=225 KN, μs=0.4, $F_3$=225 KN; μ=0.1, $G_t$=2500 KN, $F_4$=250 KN; $A_{exc}$=0.64 m$^2$, K=0.45, $P_{w1}$=237.5 KN/m$^2$, $F_5$=68.4 KN; and $\mu_1$=0.3, $L_m$=7.25 m.

When the tunneling mileage of the shield machine is at K25+156.235, the warning device is triggered to send out an alert signal in the form of an audio and lighting warning signal. At this time, the pressure measured by the earth pressure sensors 21, 22, 23 and 24 are $P_{e1}$=209 KN/m$^2$, $\theta_{ez}$=230 KN/m$^2$, $\theta_{ey}$=227 KN/m$^2$, and $P_{e2}+P_g$=275 KN/m$^2$ respectively.

According to Formula (9), the friction resistance $F_1$ between the shield body and the stratum is calculated to be 10040.47 KN.

$$F_t/K_{xz}-(F_2+F_3+F_4+F_5)=28495.5/1.05-(16573.9+225+250+68.4)=10021.3 \text{ KN}$$

According to the abovementioned calculated results, it is determined that $F1>Ft/Kxz-(F_2+F_3+F_4+F_5)$, which indicates that the determining condition of formula (3) is not fulfilled. Accordingly, the shield machine is proved to fail to propel normally.

At this time, other auxiliary engineering measures should be adopted. This method includes casting of bentonite grout into the outer wall of the shield body to reduce the friction between the shield body and the stratum. The bentonite grout contains essentially of sodium bentonite with small amounts of industrial grade pure alkaline and cellulose. The ratio of alkaline is 4%, the ratio of cellulose is 2%, and the ratio of water and bentonite is 4:1. At the same time, the opening pressure of the overflow valve 52 is temporarily increased from 25000 KN/m$^2$ to 30000 KN/m$^2$. According to the determining condition of formula (3), the condition at which the shield machine propels normally is $F_1 \leq Ft/Kxz-(F_2+F_3+F_4+F_5)$, and the friction $F_1$ between the shield body and the stratum can be decreased through the injection of bentonite grout. The total propulsion force $F_t$ of the propulsion oil cylinder 5 can be increased from 28495.5 KN to 34194.6 KN through temporarily increasing the opening pressure of the overflow valve 52. Under the dual effect of decreasing $F_1$ and increasing $F_t$, the shield machine can finally meets the determining conditions of the inequality formula (3) and enters into a normal propulsion state. At this time, the warning device stops sending out alert signal.

What is claimed is:

1. A method of preventing shield-jamming of an earth pressure balance shield machine caused by excessive friction in a construction comprises the steps of:

carrying out real-time monitoring of earth pressure signals for earth pressure between a shield body of the shield machine and a stratum through a plurality of earth pressure sensors arranged on a shield casing of the shield body of the shield machine;

calculating a total propulsion force ($F_t$) of a propulsion oil cylinder of the shield machine, a head friction ($F_2$) of a cutting disk of the shield machine, a friction ($F_3$) between a tail seal of the shield machine and a pipe sheet, a friction ($F_4$) between a wheel set of a backup trailer and steel rails, and an axial component force ($F_5$) produced by water and earth pressure acted on a cutter of the cutting disk when the cutting disk has a cutting action; and inputting the total propulsion force ($F_t$) of the propulsion oil cylinder of the shield machine, the head friction ($F_2$) of the cutting disk of the shield machine, the friction ($F_3$) between the tail seal of the shield machine and the pipe sheet, the friction ($F_4$) between the wheel set of the backup trailer and the steel rails, and the axial component force ($F_5$) produced by the water and earth pressure acted on the cutter when the cutting disk has a cutting action together with a correction coefficient (Kxz) into a CPU (Central Processing Unit) module of a PLC (Programmable logic controller) through a programming device; and simultaneously inputting the earth pressure signal detected by the earth pressure sensors into the CPU module through an input module; then calculating the friction ($F_1$) between the shield body and the stratum based on the earth pressure signals detected by the earth pressure sensors; and finally determining whether the friction ($F_1$) between the shield body and the stratum is less than or equal to a determining value, which is the difference between a quotient of dividing the total propulsion force ($F_t$) of the propulsion oil cylinder of the shield machine by the correction coefficient (Kxz) and the total resistance of $F_2$, $F_3$, $F_4$ and $F_5$; if the friction ($F_1$) is less than or equal to the determining value, then the shield machine is determined to have a normal condition; if the friction ($F_1$) is greater than the determining value, then an alert device is triggered to shut down the shield machine such that engineering measures for pretreatment of stratum, auxiliary engineering measures or both of the engineering measures for pretreatment of stratum and the auxiliary engineering measures are employed to prevent shield-jamming and forced shut down of the shield machine.

2. The method of preventing shield jamming of an earth pressure balance shield machine caused by excessive friction in a construction according to claim 1, wherein the engineering measures for pretreatment of stratum comprises the step of: injecting grout materials into the stratum to reinforce the stratum.

3. The method of preventing shield jamming of an earth pressure balance shield machine caused by excessive friction in a construction according to claim 2, wherein if the stratum is a gravel sediments layer, the step of injecting grout materials employs a permeation grouting method and the grout materials essentially consists of aqueous solution of waterglass-sodium aluminate grout (sodium silicate-sodium aluminate grout), modified waterglass (modified sodium silicate), Portland cement-waterglass grout or ultrafine cement-waterglass grout; and wherein if the stratum is a clay layer, the step of injecting grout materials employs a compaction or fracture grouting method and the grout materials essentially consists of a cement-loess-fly ash grout, a cement-waterglass double grout or a cement-sand-fly ash grout.

4. The method of preventing shield jamming of an earth pressure balance shield machine caused by excessive friction in a construction according to claim 1, wherein the auxiliary engineering measures comprises at least one of the steps of: (a) casting a bentonite grout into the stratum to provide a lubricating effect; and (b) temporarily increasing a pressure of an overflow valve of a hydraulic system of the shield machine.

5. A system of preventing shield-jamming of an earth pressure balance shield machine caused by excessive friction in a construction, comprising a data acquisition module, an input module, a CPU (Central Processing Unit) module, an output module and an alert device; wherein the data acquisition module comprises at least four earth pressure sensors arranged on a shield casing of a shield body of the shield machine through which earth pressure signal around the shield body is collected on a real-time basis; the data acquisition module is connected with the CPU module through the input module such that the earth pressure signal collected by the data acquisition module is transmitted to the CPU module through the input module; the CPU module calculates the friction ($F_1$) between the shield body and a stratum based on the earth pressure signal transmitted by the earth pressure sensors, and ultimately determines whether the friction ($F_1$) between the shield body and the stratum is less than or equal to a determining value, which is the difference between a quotient of dividing a total propulsion force ($F_t$) of a propulsion oil cylinder of the shield machine by a correction coefficient (Kxz) and a total friction of $F_2$, $F_3$, $F_4$ and $F_5$; wherein the $F_2$ refers to the head friction of the cutting disk of the shield machine, the $F_3$ refers to the friction between the tail seal of the shield machine and the pipe sheet, the $F_4$ refers to the friction between the wheel set of the backup trailer and the steel rails, and the $F_5$ refers to the axial component force produced by the water and earth pressure acted on the cutter, wherein if the friction ($F_1$) is less than or equal to the determining value, then the shield machine is determined to have a normal condition; if the friction ($F_1$) is greater than the determining value, then an alert device is triggered to sending an alert signal.

* * * * *